US005443630A

United States Patent [19]

von der Eltz et al.

[11] Patent Number: 5,443,630

[45] Date of Patent: Aug. 22, 1995

[54] INKJET SINGLE-PHASE REACTIVE PRINTING

[75] Inventors: Andreas von der Eltz; Andreas Schrell, both of Frankfurt am Main; Hans-Helmut Steuernagel, Kelkheim, all of Germany

[73] Assignee: Hoechst Aktiengesellschaft, Frankfurt am Main, Germany

[21] Appl. No.: 204,741

[22] Filed: Mar. 2, 1994

[30] Foreign Application Priority Data

Mar. 2, 1993 [DE] Germany ..... 43 06 433.7

[51] Int. Cl.[6] ..... C09D 11/02

[52] U.S. Cl. ..... 106/22 R

[58] Field of Search ..... 106/22 R, 22 D, 22 K

[56] References Cited

U.S. PATENT DOCUMENTS

| | | | |
|---|---|---|---|
| 1,953,908 | 4/1934 | Lubs et al. | 8/5 |
| 3,980,426 | 9/1976 | Feess et al. | 8/543 |
| 4,500,321 | 2/1985 | Hugelshofer et al. | 8/527 |
| 4,647,285 | 3/1987 | Scheibli | 8/528 |
| 5,273,551 | 12/1993 | Brehme et al. | 8/543 |
| 5,348,557 | 9/1994 | von der Eltz et al. | 8/565 |

FOREIGN PATENT DOCUMENTS

| | | |
|---|---|---|
| 2405057 | 1/1977 | Germany . |
| 63-68680 | 3/1988 | Japan . |
| 63-145379 | 6/1988 | Japan . |
| 3-205179 | 9/1991 | Japan . |

OTHER PUBLICATIONS

Chemical Abstact No. 102, No. 1, Jan. 14, 1985, abstract No. 8136u.

Chemical Abstract, vol. 84, No. 20, May 17, 1976, abstract No. 137151a.

Derwent Abstract Publication, JP-A-63,072,584, Apr. 2, 1988.

Patent Abstract of Japan, No. JP-A-01-005,882, Jan. 20, 1989.

Research Disclosure, 13833, Bd. 138, No. 10, Oct. 1975.

European Search Report No. 94102778.1, Aug. 12, 1994.

Graham, L. A., et al, *Text. Chem. Color* 21:27-32 (1989).

Smith. Be., et al, *Text. Chem. Color* 19:23-29 (1987).

*Primary Examiner*—Helene Klemanski

*Attorney, Agent, or Firm*—Connolly & Hutz

[57] ABSTRACT

Aqueous ink formulation and a process for printing sheetlike cellulose fiber materials or materials containing cellulose fibers with reactive dyes using a single-phase inkjet process or some other non-contact minimal addon spray technique and subsequent fixation of the reactive dyes on the fiber, which comprises using an aqueous ink formulation comprising an alkali metal fluoride, an alkali metal formate, an alkali metal citrate, an alkali metal salt of a $C_2$-$C_4$-dicarboxylic acid or a mixture thereof.

23 Claims, No Drawings

INKJET SINGLE-PHASE REACTIVE PRINTING

Cellulose fiber textile materials such as woven fabrics, knitted fabrics, yarns and nonwovens can be dyed with anionic dyes by known methods. Of late the conventional dyeing methods of printing, exhaust dyeing and padding have been joined by a modern spray technique which goes by the name of inkjet printing and before it became to be applied to textile materials was first applied to paper.

The inkjet printing process is the only one of the noncontact printing processes which makes it possible to produce colored images rapidly, quietly and in high resolution. The process is usually carried out with aqueous inks, which are sprayed as small droplets directly on to the substrate. There is a continuous form of the process, in which the ink is pressed at a uniform rate through a nozzle and the jet is directed on to the paper, or into an ink collector, by an electric field depending on the pattern to be printed, and there is an interrupted inkjet or drop-on-demand process, in which the ink is expulsed only where a colored dot is to appear, the latter form of the process employing a piezoelectric crystal or a heated hollow needle (bubble or thermal jet process) to exert pressure on the ink system and so eject an ink droplet. These techniques are described in Text. Chem. Color 19(8), 23–29 and 21 (6), 27–32.

All dyeing methods for cellulose-containing substrates have in common that the fixation of a reactive dye on the fiber requires alkali. The alkali is applied before, during or after the dyeing process. Single-phase printing means the simultaneous application of alkali and dye. Afterwards a temperature treatment, for example with dry heat, steam or microwaves, is carried out to fix the dye. It is possible, then, to add the alkali, for example NaOH or $Na_2CO_3$, directly to the ink and then to spray it onto cellulose-containing fabric using an inkjet printer. This has the disadvantage that at the prevailing pH conditions the dyes rapidly hydrolyze or, in the case of vinyl sulfone dyes, vinylize, and the ink is not stable for more than a few hours. Furthermore, precipitates occur within the printing cartridges and block the nozzle of the ink jet printer. One way of circumventing the problem mentioned is to use instead of the customary alkalis an alkali donor, for example sodium trichloroacetate, which gives off chloroform in the course of the subsequent temperature treatment and intermediately releases alkali (Japanese Patent Application Publication sho-63-68680). It is useful in this connection to use moisture-containing agents, for example N-methylpyrrolidone, caprolactam or glycol ethers (Japanese Patent Application Publication sho-63-145379), since a certain residual moisture is necessary for energy transfer and reaction. The reaction in question proceeds according to the following scheme:

$$Cl_3CCOONa + H_2O \xrightarrow{\Delta} NaHCO_3 + CHCl_3;$$

$$2NaHCO_3 \xrightarrow{\Delta} Na_2CO_3 + CO_2 + H_2O$$

In this way it is possible to print even blend fabrics of polyester and cellulose in combination with disperse dyes. This requires a gentle addition of alkali, since many disperse dyes are sensitive to alkali (DE-A-2405057). A further possibility is pretreating the textiles with trihaloacetates, drying and subsequently printing with inkjet inks (japanese Patent Application hei-3-205179), which, however, represents a two-phase printing process.

It is an object of the present invention to provide a single-phase inkjet process for printing sheetlike cellulose fiber materials, or materials containing cellulose fibers, with reactive dyes, which avoids the disadvantages of the prior art, in particular the decomposition of the dye or an evolution of toxic hydrohalocarbons.

It has now been found that alkali metal fluorides and also alkali metal salts of formic acid, citric acid and $C_2$–$C_4$-dicarboxylic acids are suitable for use as alkaline agents in inkjet printing with reactive dyes.

The present invention accordingly provides a process for printing sheetlike cellulose fiber materials or materials containing cellulose fibers with reactive dyes using a single-phase inkjet process or some other non-contact minimal addon spray technique and subsequent fixation of the reactive dyes on the fiber, which comprises using an aqueous ink formulation comprising an alkali metal fluoride, an alkali metal formate, an alkali metal citrate, an alkali metal salt of a $C_2$–$C_4$-dicarboxylic acid or a mixture thereof.

The preferred alkali metals for the alkali metal salts mentioned are lithium, sodium and potassium. Particularly preferred metal salts are sodium fluoride, potassium fluoride, lithium formate, sodium formate, potassium formate, sodium citrate, potassium citrate, sodium oxalate, potassium oxalate, lithium citrate, lithium malonate, sodium malonate, potassium malonate, in particular sodium formate and potassium fluoride.

The fiber materials printed by the process of the invention are cellulose fiber materials which may also contain admixtures of other fiber materials, for example polyester fibers. The cellulose fibers need not necessarily have been pretreated, for example by means of alkali-containing printing or padding pastes or by amination of the cellulose.

Examples of cellulose fiber materials which can be printed by the process of the invention are woven fabrics, knitted fabrics and nonwovens made of cotton, staple viscose, filament viscose or other regenerated cellulose fibers.

Examples of cellulose fiber-containing materials which can be printed by the process of the invention are woven fabrics, knitted fabrics and nonwovens which contain polyamide fibers or polyester fibers as well as cellulose fibers. Of particular preference are blend fabrics of polyester/cotton, in which case it is advantageous to use mixtures of reactive dyes with disperse dyes.

The application of the ink formulation onto the fiber material to be printed is effected with the aid of commercial inkjet printers which, if necessary, are retrofitted for industrial purposes. Use is made of aqueous solutions of the reactive dyes which contain the alkali metal salts of the invention in a concentration from 30 to 300 g/l of solution, preferably 100 to 200 g/l of solution. The concentration of the reactive dye(s) in the ink formulation is from 10 to 200 g per liter of ink formulation.

The dye solutions may contain auxiliaries as usually present in inks for inkjet printers, if necessary, such as antiaggregants, such as N-methylpyrrolidone, dimethylformamide and dimethylacetamide; wetting agents, such as ionic or nonionic surfactants and hydrotropic substances, such as urea, caprolactam, glycol or a glycol monoalkyl ether. Hydrotropic substances are advantageous in particular when the alkali donor is present in concentrations above 100 g/l of solution. It is then advantageous to add from 5 to 50 g of hydrotropic substance/l of solution. Also advantageous is an addition of salts containing water of crystallization, for example lithium chloride, lithium sulfate, sodium citrate, sodium sulfate and also lithium formate, and the water of crystallization may already be present in the alkali metal salts of the invention.

Reactive dyes are used in the form free of electrolyte salts, such as sodium chloride. However, commercial dye preparations containing up to 50% by weight of electrolyte salt are also generally easily applied by the inkjet printing technique of the process according to the invention. In multicolor printing a plurality of ink cartridges can be connected in series, which are controllable by the present-day customary means for the purpose of creating the print on the moving sheet of material. It is also possible to use modern multichamber inkjet cartridges, whereby a plurality of colors can be applied at the same time in a single pass.

With intermediate cartridge change, the printing stock can be reintroduced up to four times. In commercial paper printing machines the textile is spot-adhered to paper by means of double-sided adhesive tape. In larger machines and in particular with regard to a continuous process, a plurality of printers can be connected in series, which ensures good reproducibility in the case of long lengths of material. In multicolored ink cartridges or systems which can apply a plurality of colors simultaneously in a single pass, even relatively complex prints are possible with little effort.

The ink formulation is applied to the material to be dyed in a specific manner in tiny ink droplets by the ink jet printing process. The material dyed in this way is then subjected to a treatment with superheated steam, hot air or some other form of energy, such as electromagnetic irradiation in the microwave or radio-frequency region, to fix the dyes on the fiber material. The duration of this heat treatment is from about 20 to 180 seconds in the case of hot air and from about 3 to 20 minutes in the case of superheated steam. Low temperatures require longer fixing times than high temperatures. Preference is given to fixing at 103° C. in saturated steam for from 10 to 15 minutes, at 130° C. for from 5 to 15 minutes in superheated steam or at from 190°to 210° C. in hot air for from 45 to 90 seconds.

The printed material is finished in a conventional manner by rinsing, soaping and further rinsing and drying.

The process of the invention gives strong prints having the customary good fastness properties. Different depths of shade and the same hue are very simple to obtain with the inkjet process, for instance by controlling the amount of dye solution applied, for example by repeatedly overprinting the same line, or else by screening and printing a fine pattern of dots which with present-day inkjet printers, depending on the process, can have a resolution of better than 400 dpi. Without having to make up dyeing liquor again it is thus possible to obtain a multiplicity of color intensities (color saturation levels).

The dyeing process of the invention can be carried out with any water-soluble, fiber-reactive dye. Fiber-reactive dyes are organic dyes which contain 1, 2, 3 or 4 fiber-reactive radicals of the aliphatic, aromatic or heterocyclic series. These dyes are described in the literature in large numbers. They can belong to a wide range of dye classes, for example the class of the monoazo, bisazo, polyazo and metal complex azodyes, such as 1:1 copper, 1:2 chromium and 1:2 cobalt complex monoazo and bisazo dyes, and also the series of the anthraquinone dyes, copper, nickel and cobalt phthalocyanine dyes, copper formazan dyes, azomethine, nitroaryl, dioxazine, triphendioxazine, phenazine and stilbene dyes. Fiber-reactive dyes are dyes with a "fiber-reactive" group, i.e. a group capable of reacting with the hydroxyl groups of the cellulose or with the amino and possible carboxyl groups of polyamides to form a covalent chemical bond. The fiber-reactive radical can be bonded to the dye radical directly or via a bridge member; it is preferably bonded to the dye radical directly or via a possibly monoalkylatedamino group, for example a group of the formula —NH—, —N($CH_3$)—, —N($C_2H_5$)—or —N($C_3H_7$)—, or via an aliphatic radical, such as methylene, ethylene, propylene or an alkylene radical of 2 to 8 carbon atoms which is interrupted by one or two oxy and/or amino groups, or via an amino-containing bridge member, for example via a phenylamino group. Fiber-reactive radicals are for example: vinylsulfonyl, β-chloroethylsulfonyl, β-sulfatoethylsulfonyl, β-acetoxyethylsulfonyl, β-phosphatoethylsulfonyl, β-thiosulfatoethylsulfonyl, N-methyl-N-(β-sulfatoethylsulfonyl)amino, acryloyl, —CO—CCl=$CH_2$, —CO—CH=CH—Cl, —CO—CCl=CHCl, —CO—CCl=CH—$CH_3$, —CO—CBr=$CH_2$, —CO—CH=CH—Br, —CO—CBr=CH—$CH_3$, —CO—CCl=CH—COOH, —CO—CH=CCl—COOH, —CO—CBr=CH—COOH, —CO—CH=CBr—COOH, —CO—CCl=CCl—COOH, —CO—CBr=CBr—COOH, β-chloro- or β-bromo-propionyl, 3-phenylsulfonylpropionyl, 3-methylsulfonylpropionyl, 3-chloro-3-phenylsulfonylpropionyl, 2,3-dichloropropionyl, 2,3-dibromopropionyl, 2-fluoro-2-chloro-3,3-difluorocyclobutane-2-carbonyl, 2,2,3,3-tetrafluorocyclobutane-1-carbonyl or -1-sulfonyl, β-(2,2,3,3-tetrafluorocyclobut-1-yl)acryloyl, α- or β-methylsulfonylacryloyl, propiolyl, chloroacetyl, bromoacetyl, 4-(β-chloroethylsulfonyl)butyryl, 4-vinylsulfonylbutyryl, 5-(β-chloroethylsulfonyl)valeryl, 5-vinylsulfonylvaleryl, 6-(β-chloroethylsulfonyl)caproyl, 6-vinylsulfonylcaproyl, 4-fluoro-3-nitrobenzoyl, 4-fluoro-3-nitrophenylsulfonyl, 4-fluoro-3-methylsulfonylbenzoyl, 4-fluoro-3-cyanobenzoyl, 2-fluoro-5-methylsulfonylbenzoyl, 2,4-dichlorotriazin-6-yl, 2,4-dichloropyrimidin-6-yl, 2,4,5-trichloropyrimidin-6-yl, 2,4-dichloro-5-nitro- or -5-methyl- or -5-carboxymethyl- or -5-carboxy- or -5-cyano- or -5-vinyl- or -5-sulfo- or -5-mono-, -di- or -trichloromethyl- or -5-methylsulfonyl-pyrimidin-6-yl, 2,5-di-chloro-4-methylsulfonylpyrimidin-6-yl, 2-fluoro-4-pyrimidinyl, 2,6-difluoro-4-pyrimidinyl, 2,6-difluoro-5-chloro-4-pyrimidinyl, 2-fluoro-5,6-dichloro-4-pyrimidinyl, 2,6-difluoro-5-methyl-4-pyrimidinyl, 2,5-difluoro-6-methyl- 4-pyrimidinyl, 2-fluoro-5-methyl-6-chloro-4-pyrimidinyl, 2-fluoro-5-nitro-6-chloro-4-pyrimidinyl, 5-bromo-2-fluoro-4-pyrimidinyl, 2-fluoro-5-cyano-4-pyrimidinyl, 2-fluoro-5-methyl-4-pyrimidinyl, 2,5,6-trifluoro-4-pyrimidinyl, 5-chloro-6-chloromethyl-2-fluoro-4-pyrimidinyl, 2,6-difluoro-5-bromo-4-pyrimidinyl, 2-fluoro-5-bromo-6-chloromethyl-4-pyrimidinyl, 2,6-difluoro-5-chloromethyl-4-pyrimidinyl, 2,6-difluoro-5-nitro-4-pyrimidinyl, 2-fluoro-6-methyl-4-pyrimidinyl, 2--fluoro-5-chloro-6-methyl-4-pyrimidinyl, 2-fluoro-5-chloro-4-pyrimidinyl, 2-fluoro-6-chloro-4-pyrimidinyl, 6-trifluoromethyl-5-chloro-2-fluoro-4-pyrimidinyl, 6-trifluoromethyl-2-fluoro-4-pyrimidinyl, 2-fluoro-5-nitro-4-pyrimidinyl, 2-fluoro-5-trifluoromethyl-4-pyrimidinyl, 2-fluoro-5-phenyl- or -5-methylsulfonyl-4-pyrimidinyl, 2-fluoro-5-carboxamido-4-pyrimidinyl, 2-fluoro-5-carbomethoxy-4-pyrimidinyl, 2-fluoro-5-bromo-6-trifluoromethyl-4-pyrimidinyl, 2-fluoro-6-carboxamido-4-pyrimidinyl, 2-fluoro-6-carbomethoxy-4-pyrimidinyl, 2-fluoro-6-phenyl-4-pyrimidinyl, 2-fluoro-6-cyano-4-pyrimidiny1, 2,6-difluoro-5-methylsulfonyl-4-pyrimidinyl, 2-fluoro-5-sulfonamido-4-pyrimidinyl, 2-fluoro-5-chloro-6-carbomethoxy-4-pyrimidinyl, 2,6-difluoro-5-trifluoromethyl-4-pyrimidinyl, 2,4-bis-(methylsulfonyl)pyrimidin-4-yl, 2,5-bis(methylsulfonyl)-5-chloropyrimidin-4-yl, 2-methylsulfonylpyrimidin-4-yl, 2-phenylsulfonylpyrimidin-4-yl, 2-methylsulfonyl-5-chloro-6-methylpyrimidin-4-yl, 2-methylsulfonyl-5-bromo-6-methylpyrimidin-4-yl, 2-methylsulfonyl-5-chloro-6-ethylpyrimidin-4-yl, 2-methylsulfonyl-5-chloromethylpyrimidin-4-yl, 2-methylsulfonyl-5-nitro-6-methylpyrimidin-4-yl, 2,5,6-trismethylsulfonylpyrimidin-4-yl, 2-methylsulfonyl-5,6-dimethylpyrimidin-4-yl, 2-ethylsulfonyl-5-chloro-6-methylpyrimidin-4-yl, 2-methylsulfonyl-6-chloropyrimidin-4-yl, 2,6-bis(methylsulfonyl)-5-chloropyrimidin-4-yl, 2-methylsulfonyl-6-carboxypyrimidin-4-yl, 2-methylsulfonyl-5-sulfopyrimidin-4-yl, 2-methylsulfonyl-6-carbomethoxypyrimidin-4-yl, 2-methylsulfonyl-5-carboxypyrimidin-4-yl, 2-methylsulfonyl- 5-cyano-6-methoxypyrimidin-4-yl, 2-methylsulfonyl-5-chloropyrimidin-4-yl, 2-sulfoethylsulfonyl-6-methylpyrimidin-4-yl, 2-methylsulfonyl-5-bromopyrimidin-4-yl, 2-phenylsulfonyl-5-chloropyrimidin-4-yl, 2-carboxymethylsulfonyl-5-chloro-6-methylpyrimidin-4-yl, 2,4-dichloropyrimidine-6-carbonyl or -6-sulfonyl, 2,4-dichloropyrimidine-5-carbonyl or -5-sulfonyl, 2-chloro-4-methylpyrimidine-5-carbonyl, 2-methyl-4-chloropyrimidine-5-carbonyl, 2-methylthio-4-fluoropyrimidine-5-carbonyl, 6-methyl-2,4-dichloropyrimidine-5-carbonyl, 2,4,6-trichloropyrimidine-5-carbonyl, 2,4-dichloropyrimidine-5-sulfonyl, 2,4-dichloro-6-methylpyrimidine-5-carbonyl or -5-sulfonyl, 2-methylsulfonyl-6-chloropyrimidin-4-yl and -5-carbonyl, 2,6-bis(methylsulfonyl)pyrimidine-4- or -5-carbonyl, 2-ethylsulfonyl-6-chloropyrimidine-5-carbonyl, 2,4-bis(methylsulfonyl)pyrimidine-5-sulfonyl, 2-methylsulfonyl-4-chloro-6-methylpyrimidine-5-sulfonyl or -5-carbonyl, 2-chloroquinoxaline-3-carbonyl, 2- or 3-monochloroquinoxaline-6-carbonyl, 2- or 3-monochloro-quinoxaline-6-sulfonyl, 2,3-dichloroquinoxaline-5- or -6-carbonyl, 2,3-dichloroquinoxaline-5- or -6-sulfonyl, 1,4-dichlorophthalazine-6-sulfonyl or -6-carbonyl, 2,4-dichloroquinazoline-7- or -6-sulfonyl or -carbonyl, 2,4,6-trichloroquinazoline-7- or -8-sulfonyl, 2- or 3- or 4-(4', 5'-dichloropyridaz-6'-on-1'-yl)phenylsulfonyl or -carbonyl, β-(4',5'-dichloropyridazin-6'-on-1'-yl)propionyl, 3,6-dichloropyridazine-4-carbonyl or -4-sulfonyl, 2-chlorobenzothiazole-5- or -6-carbonyl or -5- or -6-sulfonyl, 2-arylsulfonyl- or 2-alkylsulfonylbenzothiazole-5- or -6-carbonyl or -5- or -6-sulfonyl, such as 2-methylsulfony1 or 2-ethylsulfonylbenzothiazole-5- or -6-sulfonyl or -carbonyl, 2-phenylsulfonylbenzothiazole-5- or -6-sulfonyl or -carbonyl and the corresponding 2-sulfonylbenzothiazole-5- or -6-carbonyl- or -sulfonyl derivatives with sulfo groups in the fused-on benzene ring, 2-chlorobenzoxazole-5- or -6-carbonyl or -sulfonyl, 2-chlorobenzimidazole-5- or -6-carbonyl or -sulfonyl, 2-chloro-1-methylbenzimidazole-5- or -6-carbonyl or -sulfonyl, 2-chloro-4-methylthiazole(1,3)- 5-carbonyl or -4- or -5-sulfonyl, ammonium-containing triazine rings, such as 2-trimethylammonium-4-phenylamino- and -4-(o, m- or p-sulfophenyl)amino-6-triazinyl, 2-(1,1-dimethylhydrazinium)-4-phenylamino- and -4-(o-, m- or p-sulfophenyl)amino-6-triazinyl, 2-(2-isopropylidene-1,1-dimethyl)hydrazinium-4-phenylamino- and -4-(o-, m- or p-sulfophenyl)amino-6-triazinyl, 2—N-aminopyrrolidinium-, 2-N-aminopiperidinium-4-phenylamino- or -4-(o-, m- or p-sulfophenyl)amino-6-triazinyl, 4-phenylamino- or 4-(sulfophenylamino)-6-triazinyl which contains 1,4-bis-azabicyclo[2.2.2] octane or 1,2-bisazabicyclo[0.3.3] octane bonded in quaternary fashion in the 2-position via a nitrogen bond, 2-pyridinium-4-phenylamino- or -4-(o-, m- or p-sulfophenyl) amino-6-triazinyl and corresponding 2-onium-6-triazinyl radicals which are substituted in the 4-position by alkylamino, such as methylamino, ethylamino or β-hydroxyethylamino, or alkoxy, such as methoxy or ethoxy, or aryloxy, such as phenoxy or sulfophenoxy.

After the dye has been fixed on the substrate, it is sufficient to rinse the dyed substrate as usual one or more times with warm or hot and, if necessary, cold water.

Especially when printing materials containing cellulose fibers, for example textiles in polyester/cellulose fibers, it is advantageous to add a disperse dye to the ink formulation. Suitable disperse dyes include all customary disperse dyes, for example those of the group of the azo, nitro, anthraquinone, methine, quinoline, benzimidazole and oxazine dyes.

The amount of disperse dye added to the ink formulation is advantageously from 10 to 150, preferably from 10 to 100, g per liter of ink formulation, which necessarily contains dimethylformamide, N-methylpyrrolidone or other solvents for disperse dyes.

It is also possible, in principle, to pretreat the fiber material in a first step with a padding liquor which contains the alkali donor with or without thickeners such as alginates, to dry at temperatures of up to a maximum of 100° C., and then, in a second step, to apply an aqueous dye solution by printing. However, this variant is a two-stage process and does not form part of the subject matter of the present invention.

The present invention also provides an aqueous ink formulation for inkjet printing or for any other noncontact minimal addon spray technique, consisting essentially of a) an aqueous solution of a reactive dye, b) at least one alkali metal fluoride, alkali metal formate, alkali metal citrate or alkali metal salt of a $C_2$–$C_4$-dicarboxylic acid, and optionally of c) one or more disperse dyes, d) one or more salts containing water of crystallization, e) hydrotropic substances and/or f) further customary additives, for example antiaggregants, wetting agents, ionic or nonionic surfactants.

The concentrations of the reactive dyes, of the alkalis and of the optionally added disperse dyes, salts containing water of crystallization and/or hydrotropic substances in the aqueous ink formulation were mentioned above in connection with the description of the process according to the invention.

The process of the invention makes it possible to achieve pale and deep shades on cellulose fibers or materials containing cellulose fibers with good color strength and excellent contour crispness.

Further advantages of the inkjet printing process according to the invention are its simplicity, the inexpensive availability of the alkali and the environmental friendliness of the reaction and the reaction products.

The Examples which follow serve to illustrate the invention. The parts mentioned are parts by weight and the percentages too are by weight, unless otherwise stated. Parts by weight relate to parts by volume as the kilogram relates to the liter.

EXAMPLE 1

A fabric made of mercerized and bleached cotton is passed by means of one or two guiding and tensioning rolls underneath an inkjet printer and printed with an aqueous 6% strength solution of the dye of the formula

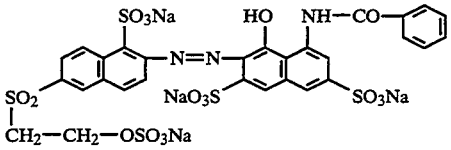

known from German Offenlegungsschrift No. 1,943,904 with a high dye solution add-on in the presence of 20% of sodium formate, based on the dye solution. The fabric thus printed is then steamed at 105° C. for 15 minutes, thereafter rinsed with cold and hot water in the presence or absence of a commercial wetting agent in the hot water, if necessary rinsed once more with cold water, and dried.

The result obtained with minimal liquor addon and minimal wastewater pollution is a strong crisp red print which has good allround fastness properties, in particular good wash and light fastness properties.

EXAMPLE 2

A mercerized and bleached cotton fabric is printed for example in a commercial office inkjet printer with water-soluble fiber-reactive dyes, the subtractive color mixing primaries (yellow, cyan, magenta and additionally black) being applied in one operation. Each ink contains 10% of dye and 20% of sodium formate. Subsequent fixation is effected with a steamer at 105° C. in the course of 20 minutes and is followed by a hot wash.

EXAMPLE 3 a) A fabric made of mercerized and bleached cotton is attached to a base and printed in a commercial office inkjet printer with 6% strength aqueous solutions of fiber-reactive dyes by applying the subtractive color mixing primaries (yellow, cyan, magenta and additionally black) in four individual passes in succession. The dye solutions each contain 15% of potassium fluoride. Subsequent fixation is effected using a high-temperature steamer at 130° C. and followed by a hot wash.

b) To prepare an orange print it is possible to use for example the alkali metal salt of the dye of the formula

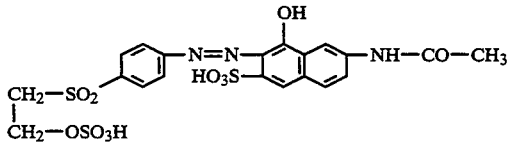

known from European Patent Application Publication No. 0 061 151. A crisp pattern is obtained with minimal dye solution addon. Fixation of the dye in a steamer gives fast orange dyeings.

EXAMPLE 4

A mercerized and bleached cotton fabric is printed on a flatbed printer, with exclusive movement of the printing head, in one operation with a fiber-reactive dye, as for example one of the dyes described in the preceding or subsequent examples, with the addition of 200 g/l of sodium formate as alkaline component. The printed material is then treated with dry heat to fix the dye and subsequently soaped hot.

EXAMPLE 5

A polyester-cellulose fabric is directly pulled in with the aid of one or two rubber rolls and printed by means of an inkjet printer in one operation with a mixture of fiber-reactive dyes, disperse dyes and 200 g/l of sodium formate in the subtractive color mixing primaries. Fixation is subsequently effected in a high-temperature steamer at 180° C. The reactive dyes are fixed on the material and the disperse dyes diffuse into the polyester fibers, so that a subsequent wash will generally detach only little by way of unfixed dye.

EXAMPLE 6 a) A viscose fabric is printed in a commercial inkjet printer using an aqueous solution of a black reactive dye (10%) and aqueous solutions of fiber-reactive dyes whose primary colors yellow (12%), cyan (10%) and magenta (9%) correspond to a subtractive color mixing in the presence of 20% of potassium fluoride. The fabric is then fixed in a high temperature steamer at 130° C. and 30% air humidity.

b) To produce a crisp brilliant red print the procedure described under a) can be adopted if a commercial inkjet printer is used to print only the aqueous solution of the dye of the formula

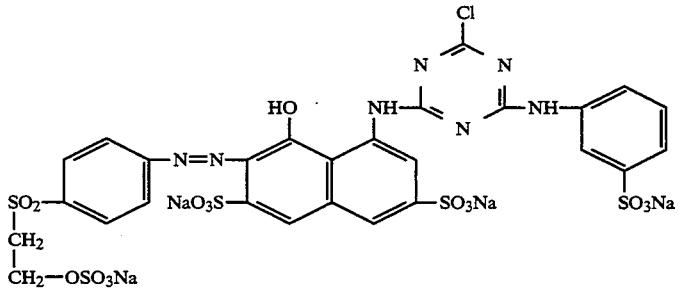

known from Example 1 of European Patent No. 0 032 187 in the presence of 20% of potassium fluoride.

The print obtained is wash-fast and has crisp contours.

EXAMPLE 7

Mercerized cotton fabric is attached to a base and printed in a commercial office inkjet printer with aqueous dye solutions in the presence of 25% of sodium formate by applying the subtractive color mixing primaries yellow (10%), cyan (8%), magenta (8%) and additionally black (10%) in succession in four individual passes. The dyes are then fixed on the material at 180° C. by means of a high temperature steamer. The material, which bears a crisp print, is then washed hot.

EXAMPLE 8

A fabric in mercerized and bleached cotton is printed in a commercial inkjet printer with a 6% aqueous solution of an alkali metal salt of the dye of the formula

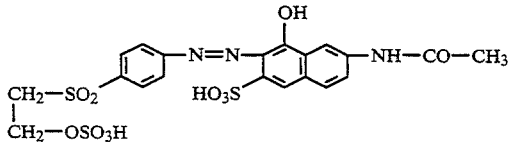

known from European Patent Application Publication No. 0 061 151 in the presence of 15% of sodium formate, based on the aqueous solution. Fixation is subsequently effected at 190° C. in a high temperature steamer. The print obtained has crisp contours, an orange color and good fastness properties.

EXAMPLES 9 to 32

To prepare further dyeings by the process of the invention, cellulose fibre material is printed with an inkjet printer, for example analogously to one of the methods described in the above embodiment examples, using aqueous solutions of one or more of the known dyes indicated below in the table examples (the dyes are written in the form of free acids however, they are used in the form of their alkali metal salts).

Bright, strong prints are obtained in the hue indicated for the respective table example and with the good fastness properties of the respective dye.

| Ex. | Dye used (in the form of an alkali metal salt) | Hue |
|---|---|---|
| 9 | 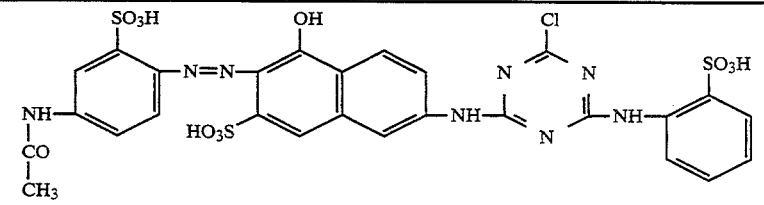 (known from CH Patent 350,390) | Scarlet |
| 10 | 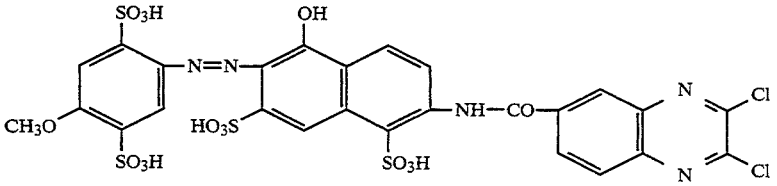 (known from DE-A-1 813 438, Ex. 1) | Scarlet |
| 11 | 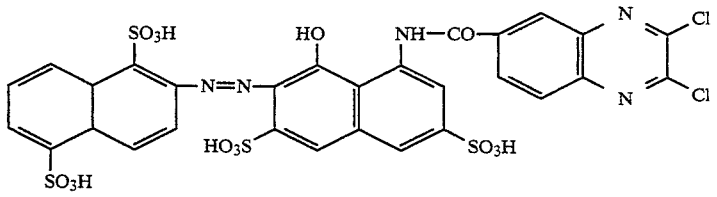 (known from DE-B-1 191 059) | Red |
| 12 | 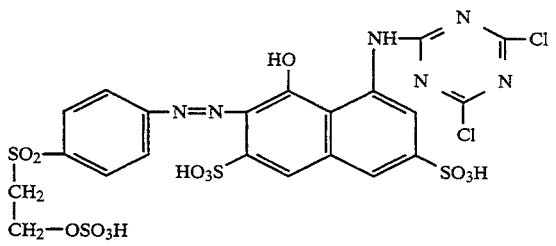 (known from JP-B-63/23287) | Red |

-continued
| Ex. | Dye used (in the form of an alkali metal salt) | Hue |
|---|---|---|
| 13 | 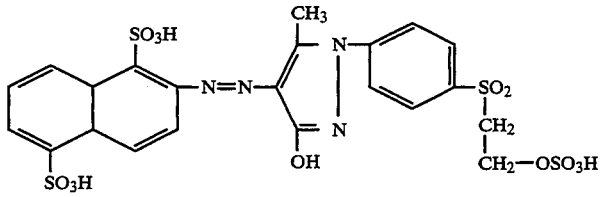 | Yellow |
| 14 | 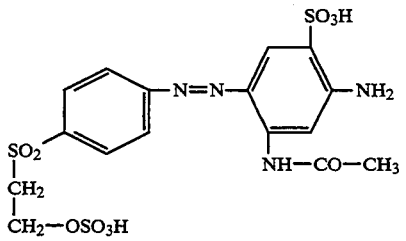 (known from EP-B-0 073 481) | Yellow |
| 15 | 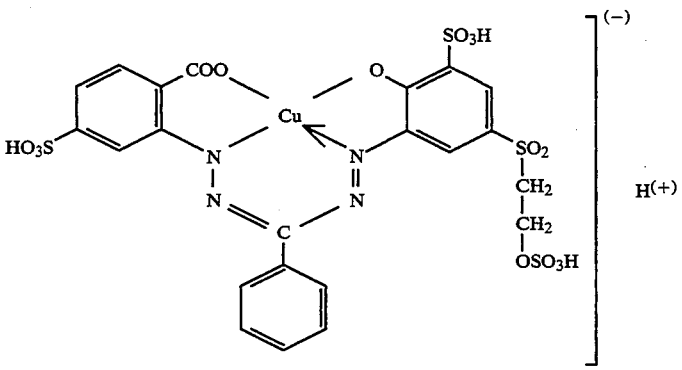 (known from EP-B-0 028 788) | Blue |
| 16 | 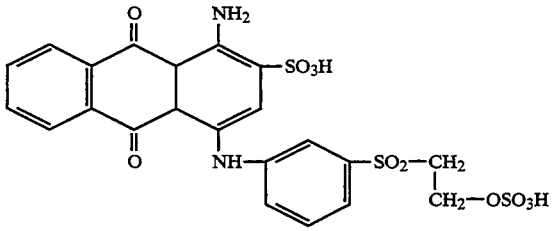 (known from Colour Index as C.I. Reactive Blue 19) | Blue |
| 17 | 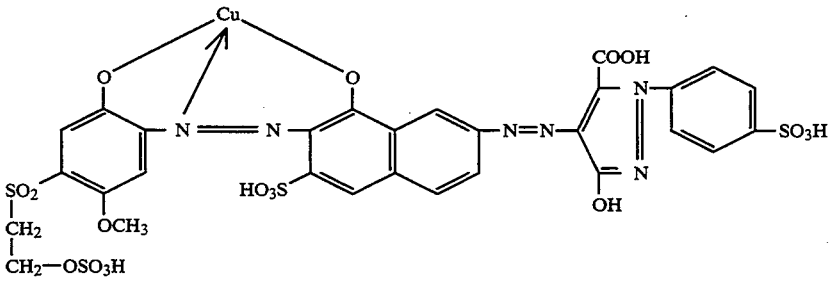 | Black |

-continued
| Ex. | Dye used (in the form of an alkali metal salt) | Hue |
|---|---|---|
| 18 | 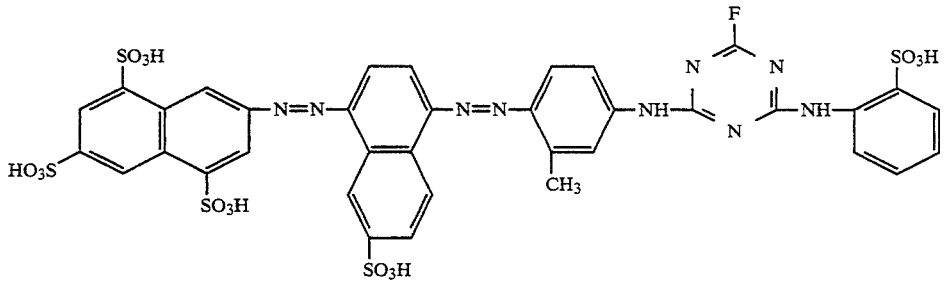 (known from DE-A-2 733 109, Ex. 2) | Reddish brown |
| 19 | 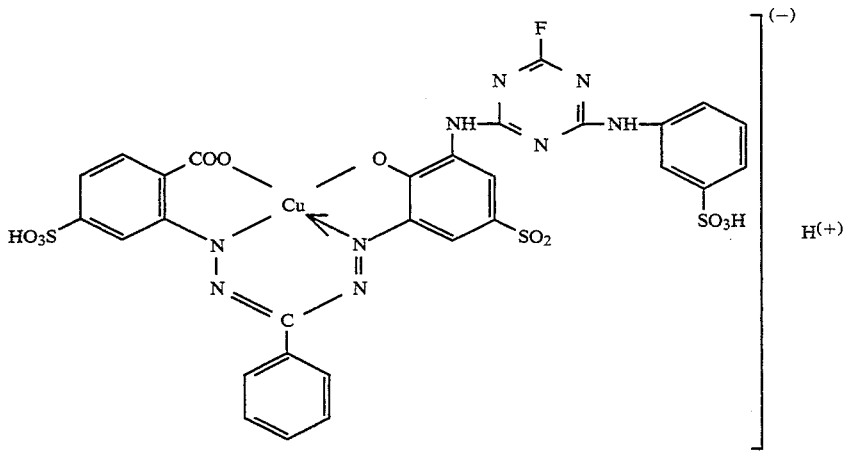 | Blue |
| 20 | 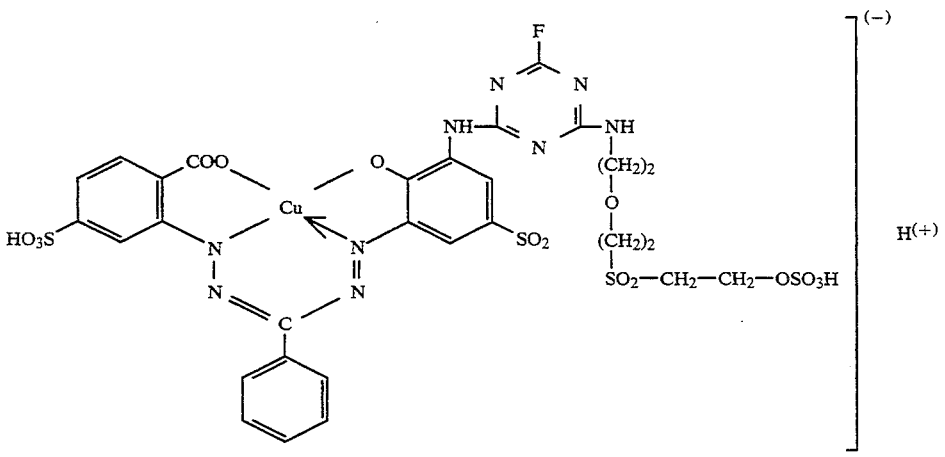 (known from EP-A-0 144 766) | Blue |

-continued
| Ex. | Dye used (in the form of an alkali metal salt) | Hue |
|---|---|---|
| 21 | 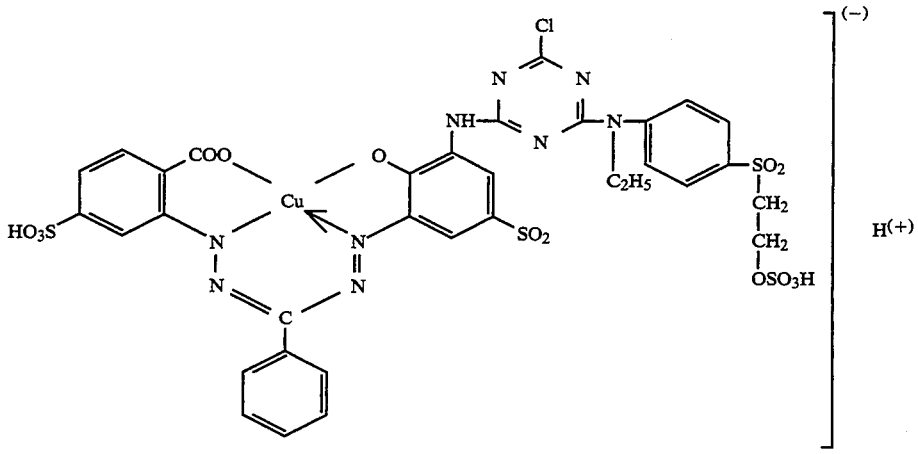 (known from EP-A-99 721) | Blue |
| 22 | 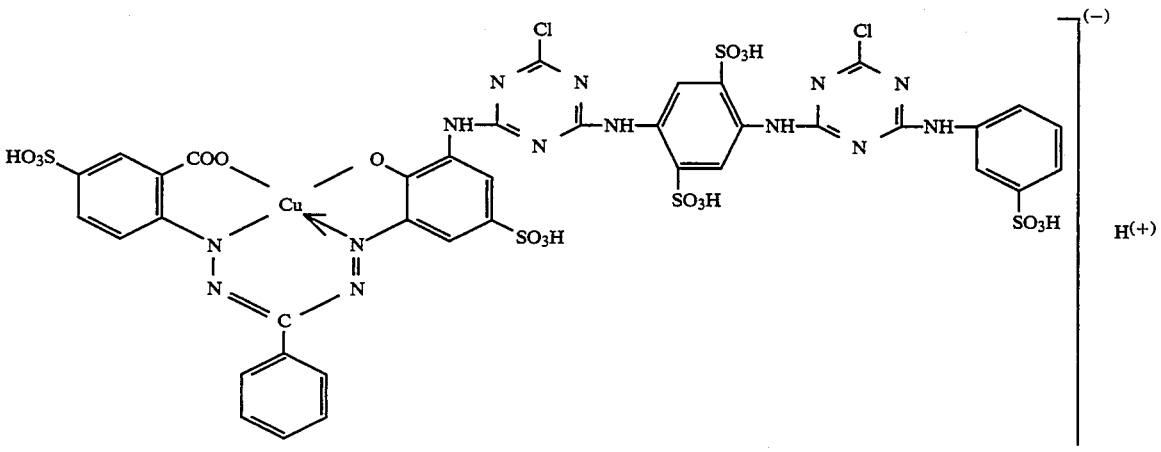 (known from DE-A-2 342 197, Ex. 2) | Blue |
| 23 | 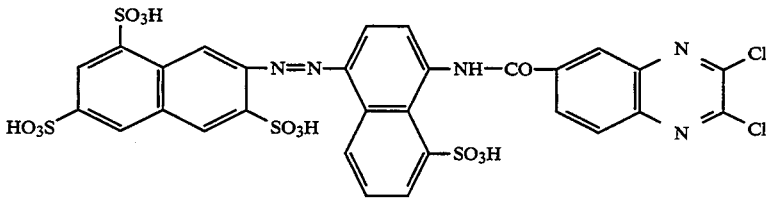 (known from DE-B-1 191 059) | Yellow |
| 24 | 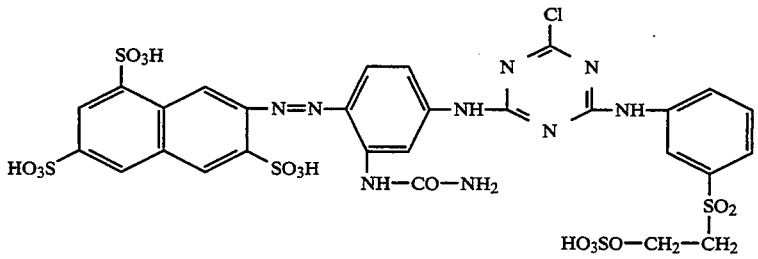 (known from European Patent Application Publication No. 0 056 975) | Yellow |

-continued
| Ex. | Dye used (in the form of an alkali metal salt) | Hue |
|---|---|---|
| 25 | 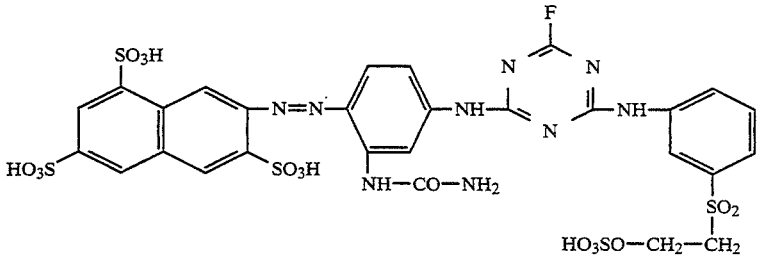 | Yellow |
| 26 | 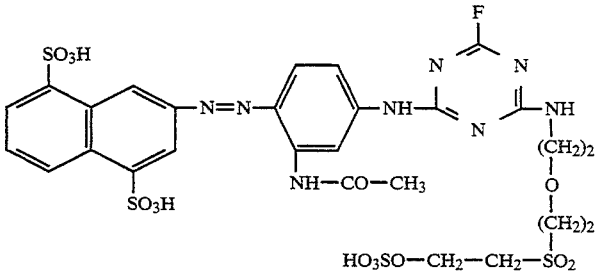 (known from EP-A-0 457 715) | Yellow |
| 27 | 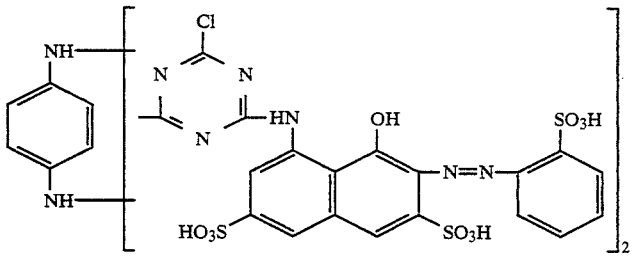 | Red |
| 28 | 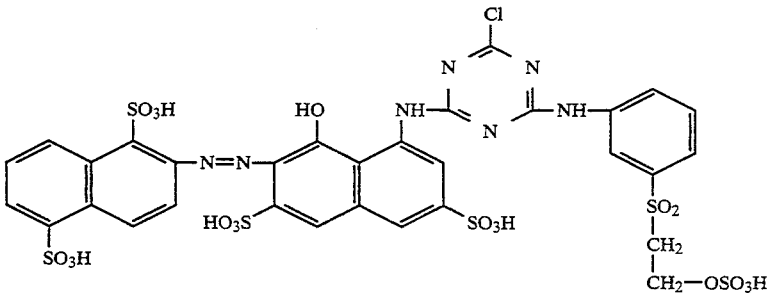 | Red |
| 29 | 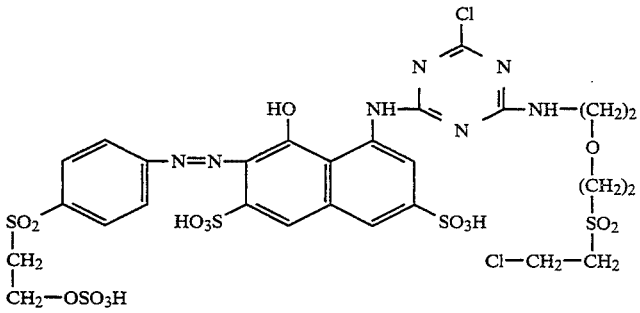 (known from EP-A-0 144 766, Ex. 5) | Red |

-continued

| Ex. | Dye used (in the form of an alkali metal salt) | Hue |
|---|---|---|
| 30 | 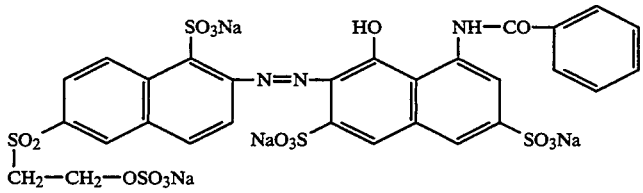 (known from EP-A-0 158 233, Ex. 3) | Red |
| 31 | 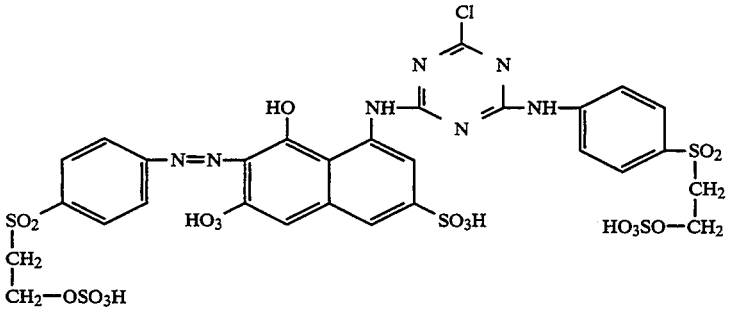 (known from EP-B-0 094 055) | Red |
| 32 | 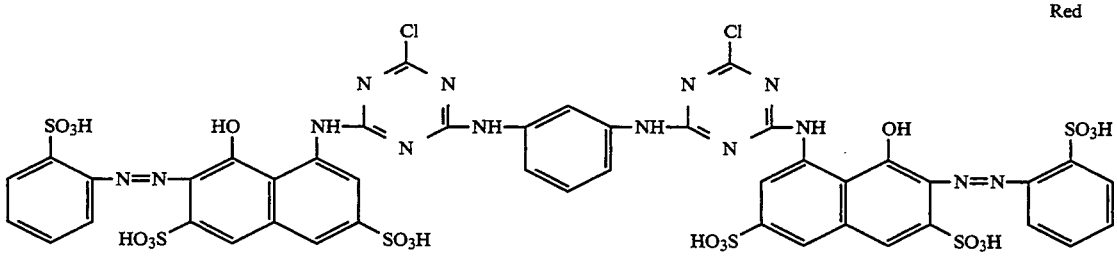 (known from DE-A-2 001 960) | Red |

What is claimed is:

1. A process for printing cellulose fiber sheet materials or sheet materials containing cellulose fibers using a single-phase inkjet process or a noncontact minimal add on spray technique to print said sheet materials with a reactive dye and subsequent fixation of the reactive dyes on the fiber, which comprises the steps of:

providing an aqueous ink formulation comprising a reactive dye and a salt selected from the group consisting of an alkali metal fluoride, an alkali metal citrate, an alkali metal salt of a $C_2$–$C_4$-dicarboxylic acid and a mixture thereof, and contacting said sheet material with a reactive dye using a single-phase non-contact add on spray technique.

2. The process of claim 1, wherein the alkali metal is lithium, sodium or potassium.

3. The process of claim 1, wherein the alkali metal salt is selected from the group consisting of sodium fluoride, potassium fluoride, sodium citrate, potassium citrate, lithium citrate, lithium malonate, sodium malonate, potassium malonate, sodium oxalate and potassium oxalate.

4. The process of claim 1, wherein the alkali metal salt is potassium fluoride.

5. The process of claim 1, wherein the alkali metal salt or mixture of alkali metal salts is present in a concentration from 30 to 300 g per liter of ink formulation.

6. The process of claim 1, wherein the alkali metal salt or mixture of alkali metal salts is present in a concentration from 100 to 200 g per liter of ink formulation.

7. The process of claim 1, wherein the ink formulation additionally contains at least one hydrotropic substance.

8. The process of claim 7, wherein the hydrotropic substance is urea, a glycol monoalkyl ether or glycol.

9. The process of claim 1, wherein the ink formulation additionally contains at least one salt containing water of crystallization.

10. The process of claim 9, wherein the at least one salt containing water of crystallization is selected from the group consisting of lithium chloride, lithium sulfate, and sodium sulfate.

11. The process of claim 1, wherein the ink formulation additionally contains at least one disperse dye.

12. The process of claim 1, wherein the fiber material to be printed is cotton, staple viscose or a polyester-cellulose blend fabric.

13. An aqueous ink formulation for inkjet printing or for any other non-contact minimal add on spray technique, consisting essentially of a) an aqueous solution of a reactive dye, b) at least one alkali metal fluoride, alkali metal citrate or alkali salt of a $C_2$–$C_4$-dicarboxylic acid, and optionally c) at least one disperse dye, d) at least one salt containing water of crystallization, e) at least one hydrotropic substance.

14. The aqueous ink formulation of claim 13, wherein component b) is or potassium fluoride.

15. The process of claim 1, wherein the alkali metal citrate is sodium citrate.

16. A process for printing cellulose fiber sheet materials or sheet materials containing cellulose fibers with reactive dyes using a single-phase inkjet process or a noncontact minimal add on spray technique and subsequent fixation of the reactive dyes on the fiber, which comprises the steps of providing an aqueous ink formulation comprising a reactive dye and comprising an alkali metal formate in a concentration of 100 to 200 g/l of said formulation, and contacting said sheet material with said aqueous ink formulation using a noncontact spray technique.

17. The process of claim 16, wherein the alkali metal formate is lithium formate, sodium formate or potassium formate.

18. The process of claim 16, wherein the ink formulation additionally contains at least one hydrotropic substance.

19. The process of claim 16, wherein the ink formulation additionally contains at least one salt containing water or crystallization.

20. The process of claim 19, wherein the at least one salt containing water of crystallization is selected from the group consisting of lithium chloride, lithium sulfate, sodium sulfate and sodium citrate.

21. The process of claim 16, wherein the ink formulation additionally contains at least one disperse dye.

22. The process of claim 16, wherein the fiber material to be printed is cotton, staple viscose, or a polyester-cellulose blend fabric.

23. A aqueous ink formulation, consisting essentially of a) an aqueous solution of a reactive dye, b) an alkali metal formate in a concentration of 100 to 200 g/l of said aqueous solution, and optionally c) at least one disperse dye, d) at least one salt containing water of crystallization, and e) at least one hydrotropic substance.

* * * * *